US007231690B2

(12) United States Patent
Bushey

(10) Patent No.: US 7,231,690 B2
(45) Date of Patent: Jun. 19, 2007

(54) FURNITURE GLIDE WITH TUBULAR FLANGED GROMMET FASTENER

(76) Inventor: Richard D. Bushey, 1596-38th Ave., Kenosha, WI (US) 53140

( * ) Notice: Subject to any disclaimer, the term of this patent is extended or adjusted under 35 U.S.C. 154(b) by 16 days.

(21) Appl. No.: 10/704,417

(22) Filed: Nov. 7, 2003

(65) Prior Publication Data

US 2004/0093687 A1 May 20, 2004

Related U.S. Application Data

(60) Provisional application No. 60/427,615, filed on Nov. 19, 2002.

(51) Int. Cl.
*A47B 91/06* (2006.01)

(52) U.S. Cl. ..... 16/42 R; 16/42 T; 16/37; 16/38; 248/188

(58) Field of Classification Search ..... 16/42 R, 16/42 T, 37–39, 30, 43; 248/188, 188.5, 248/188.6

See application file for complete search history.

(56) References Cited

U.S. PATENT DOCUMENTS

| | | | | | |
|---|---|---|---|---|---|
| 336,346 | A | * | 2/1886 | Pratt | 248/188.9 |
| 1,582,211 | A | * | 4/1926 | Fleming | 16/42 T |
| 1,867,736 | A | | 7/1932 | Finkeldey | |
| 1,914,203 | A | * | 6/1933 | Herold | 16/42 R |
| 2,030,649 | A | | 2/1936 | Miller | |
| 2,262,063 | A | | 11/1941 | Swarr | |
| 2,262,064 | A | | 11/1941 | Swarr | |
| 2,633,599 | A | | 4/1953 | Dolan | |
| 2,753,586 | A | | 7/1956 | Metz | |
| 2,794,205 | A | | 6/1957 | Skupas | |
| 2,820,240 | A | | 1/1958 | Matys | |
| 2,848,733 | A | | 8/1958 | Thornsbury | |
| 2,876,485 | A | * | 3/1959 | Cowles | 16/42 R |
| 2,878,509 | A | | 3/1959 | Fisher | |
| 2,933,754 | A | | 4/1960 | Winans | |
| 2,954,636 | A | | 10/1960 | Gammache | |
| 2,973,545 | A | * | 3/1961 | Kramcsak, Jr. | 16/42 R |
| 2,974,352 | A | | 3/1961 | Lockwood | |
| 2,988,770 | A | | 6/1961 | Arenson | |
| 2,992,509 | A | | 7/1961 | Gaenzle | |
| 3,025,631 | A | * | 3/1962 | Reynolds | 248/188.9 |
| 3,059,267 | A | | 10/1962 | Wilhelmi | |
| 3,076,221 | A | * | 2/1963 | Reynolds | 16/42 R |
| 3,191,212 | A | | 6/1965 | Reiss, Sr. et al. | |
| 3,342,445 | A | | 9/1967 | Bouwkamp | |
| 3,353,231 | A | | 11/1967 | Levine | |
| 3,366,991 | A | * | 2/1968 | Le Vasseur | 16/42 R |
| 3,640,496 | A | | 2/1972 | Duncan | |
| 3,883,923 | A | | 5/1975 | England | |
| 4,313,586 | A | * | 2/1982 | Grzesnikowski | 248/188.4 |

(Continued)

*Primary Examiner*—Katherine Mitchell
*Assistant Examiner*—Michael J. Kyle
(74) *Attorney, Agent, or Firm*—Boyle Gredrickson Newholm Stein & Gratz S.C.

(57) ABSTRACT

A furniture glide is provided for mounting on a terminal end of a furniture leg. The furniture glide includes a slider having an upper surface and a generally arcuate lower surface for engaging a supporting surface. A generally tubular fastener extends from the upper surface of the slider and is receivable in the terminal end of the furniture leg for frictionally connecting the furniture glide to the furniture leg. A spacing element may be positioned on the upper surface of the slider for spacing the upper surface of the slider from the furniture leg.

11 Claims, 2 Drawing Sheets

U.S. PATENT DOCUMENTS 4,327,461 A * 5/1982 Wisniewski ..... 16/42 R
4,468,910 A 9/1984 Morrison
D276,606 S 12/1984 Neuwirth
4,576,357 A 3/1986 Schrepfer
4,654,245 A 3/1987 Balzer et al.
4,793,580 A * 12/1988 Richards ..... 248/188
5,005,374 A 4/1991 Spitler
5,010,621 A 4/1991 Bock
5,042,764 A 8/1991 Carpinella et al.
5,057,356 A 10/1991 Smith
5,170,972 A 12/1992 Guell
5,220,705 A 6/1993 Bushey
D339,560 S 9/1993 Byrd
5,287,595 A * 2/1994 Stevens, Jr. ..... 16/42 T
D348,985 S 7/1994 Walker
D353,505 S 12/1994 Rea
5,426,818 A 6/1995 Bushey
5,557,824 A 9/1996 Bushey
5,573,212 A 11/1996 Palazzolo
5,573,213 A 11/1996 Henderson et al.
D376,944 S 12/1996 Dunn
5,591,974 A 1/1997 Troyer et al.
D381,865 S 8/1997 Gallagher
D400,088 S 10/1998 Hurrie
6,154,923 A 12/2000 Carpinella
6,186,453 B1 * 2/2001 Redbone ..... 248/188.4
6,280,817 B1 8/2001 McCrossin et al.
6,324,725 B1 12/2001 Green
6,354,231 B1 * 3/2002 Morris ..... 108/144.11
D455,383 S 4/2002 Sneed

* cited by examiner

FURNITURE GLIDE WITH TUBULAR FLANGED GROMMET FASTENER

CROSS-REFERENCE TO RELATED APPLICATION

This application claims the benefit of U.S. Provisional Application Ser. No. 60/427,615, filed Nov. 19, 2002.

FIELD OF THE INVENTION

This invention relates generally to furniture glides, and in particular, to a furniture glide that incorporates a tubular flanged grommet fastener to facilitate the mounting of the furniture glide to a furniture leg.

BACKGROUND AND SUMMARY OF THE INVENTION

Furniture glides or sliders are often mounted to the terminal ends of the legs of a piece of furniture to act as a buffer between the legs and the floor on which the piece of furniture rests. Typically, furniture glides take the form of convex discs having flat bottoms that rest on the floor. These discs are mounted to the furniture legs by means of adhesive, nails or the like.

While functional for their intended purposes, prior furniture glides have certain limitations. More specifically, repeated movement of the piece of furniture along a floor may cause the adhesive that attaches the furniture glides to the legs of the piece of furniture to fail such that the furniture glides become detached from the bottom of the piece of furniture. This, in turn, may result in the legs of the piece of furniture engaging and damaging the floor. Alternatively, the repeated movement of the piece of furniture along a floor may cause the nails used to mount the furniture glides on the legs of a piece of furniture to become loose and separate therefrom. As heretofore described, once the furniture glide become separated from a leg of a piece of furniture, the corresponding furniture leg may engage and damage the flooring. Therefore, it is highly desirable to provide a furniture glide that may be simply and easily secured to the leg of a piece of furniture so as to prevent damage to the floor upon which the piece of furniture rests.

Therefore, it is a primary object and feature of the present invention to provide a furniture glide that may be securely retained on the terminal end of a leg of a piece of furniture.

It is a further object and feature of the present invention to provide a furniture glide that is inexpensive to manufacture and simple to utilize.

It is a still further object and feature of the present invention to provide a furniture glide that may be utilized on the terminal end of a leg of a piece of furniture in order to prevent damage to the floor on which the piece of furniture sits.

In accordance with the present invention, a furniture glide is provided for mounting on a terminal end of a furniture leg. The furniture glide includes a base having an upper surface and a generally arcuate lower surface for engaging a supporting surface, such as flooring or carpeting. A generally tubular, grommet fastener extends from the upper surface of the base. The grommet fastener is receivable in the terminal end of the furniture leg for frictionally connecting the furniture glide to the furniture leg.

The furniture glide may also include a spacing collar positioned about the grommet fastener so as to be engageable with the upper surface of the base. The spacing collar may take the form of an o-ring or may be integrally molded to the grommet fastener. The grommet fastener extends along a longitudinal axis and has an upper end and a lower end. The lower end of the grommet fastener extends into the base below the upper surface. In addition, the lower end of the grommet fastener is flanged outwardly from the longitudinal axis.

In accordance with a further aspect of the present invention, a furniture glide is provided for mounting on a terminal end of a furniture leg. The furniture glide includes a slider having an upper surface and a generally arcuate lower surface terminating at a generally flat apex.to engage a supporting surface. A generally tubular fastener extends along a longitudinal axis and projects from the upper surface of the slider. The fastener is receivable in the terminal end of the furniture leg for frictionally connecting the furniture glide to the furniture leg.

The furniture glide may also include a spacing collar positioned about the fastener so as to be engageable with the upper surface of the slider. The spacing collar may take the form of an o-ring or may be integrally molded to the fastener. The fastener has an upper end and a lower end. The lower end of the fastener extends into the slider below the upper surface. In addition, the lower end of the grommet fastener is flanged outwardly from the longitudinal axis.

In accordance with a still further aspect of the present invention, a furniture glide is provided for mounting on a terminal end of a furniture leg. The furniture glide includes a slider having an upper surface and a generally arcuate lower surface for engaging a supporting surface. A generally tubular fastener extends along a longitudinal axis and projects from the upper surface of the slider. The fastener is receivable in the terminal end of the furniture leg for frictionally connecting the furniture glide to the furniture leg. A spacing element is positioned on the upper surface of the slider for spacing the upper surface of the slider from the furniture leg.

The furniture glide may also include a spacing element positioned about the fastener so as to be engageable with the upper surface of the slider. The spacing element may take the form of an o-ring or may be integrally molded to the fastener. The fastener has an upper end and a lower end. The lower end of the fastener extends into the slider below the upper surface. In addition, the lower end of the grommet fastener is flanged outwardly from the longitudinal axis.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DESCRIPTION OF THE PREFERRED EMBODIMENT

Figure 1:
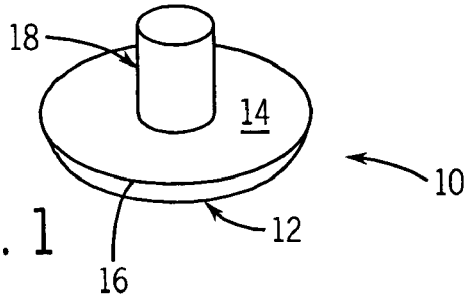
FIG. 1 is an isometric view of a first embodiment of a furniture glide in accordance with the present invention.
Figure 2:
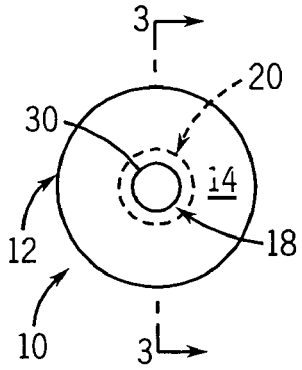
FIG. 2 is a top plan view of the furniture glide of FIG. 1.
Figure 3:
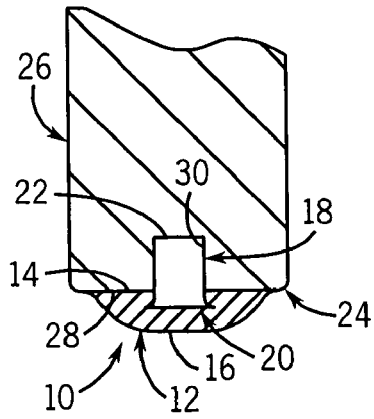
FIG. 3 is a cross-sectional view of the furniture glide of the present invention taken along line 3—3 of FIG. 2 wherein the furniture glide is mounted on a furniture leg.

Referring to FIG. 1, a furniture guide in accordance with the present invention generally designated by the reference numeral 10. Furniture glide 10 includes base 12 having a generally flat upper surface 14 and a generally arcuate floor engaging surface 16. As best seen in FIG. 3, floor engaging surface 16 of base 12 may terminate at a generally flat apex.

Furniture glide 10 further includes a tubular grommet fastener 18 defined by sidewall 30 that projects vertically from upper surface 14 of base 12 along a corresponding axis. Sidewall 30 of grommet fastener 18 has a lower flanged end 20 and an upper end 22. Flanged end 20 of sidewall 30 of grommet fastener 18 is captured within the interior of base 12 so as to interconnect grommet fastener 18 with base 12.

It is intended that furniture glide 10 be mounted on terminal end 24 of a furniture leg 26. Terminal end 24 of furniture leg 26 includes a generally flat terminal surface 28. In order to interconnect furniture glide 10 to furniture leg 26, upper end 22 of sidewall 30 of grommet fastener 18 is positioned along terminal surface 28 of furniture leg 26 at a central location. Thereafter, a hammer or similar tool is used to tap the floor engaging surface 16 of base 12 of furniture glide 10 so as to urge sidewall 30 of grommet fastener 18 into terminal end 24 of furniture leg 26. Sidewall 30 of grommet fastener 18 is driven into terminal end 24 of furniture leg 26 until such point that upper surface 14 of base 12 engages terminal surface 28 of furniture leg 26. It is contemplated that sidewall 30 of grommet fastener 18 be frictionally retained within terminal end 24 of furniture leg 26.

Figure 4:
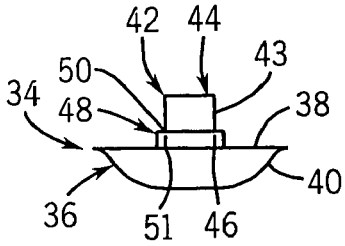
FIG. 4 is a side elevational view of a second embodiment of a furniture glide in accordance with the present invention.
Figure 5:
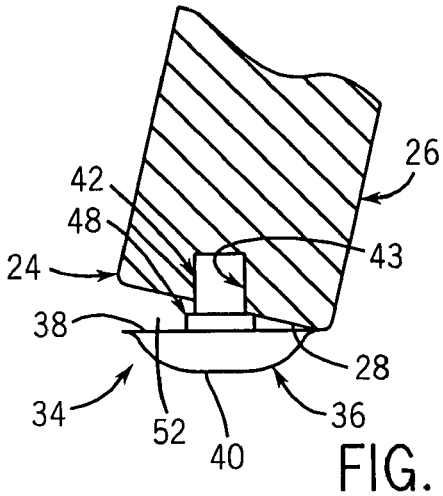
FIG. 5 is a side elevational view, partially in section, showing the furniture glide of FIG. 4 mounting on a furniture leg.

Referring to FIGS. 4—5, an alternate embodiment of a furniture glide in accordance with the present invention is generally designated by the reference numeral 34. Furniture glide 34 includes base 36 having a generally flat upper surface 38 and a generally arcuate floor engaging surface 40. It is contemplated that floor engaging surface 40 of base 36 terminate at a generally flat apex.

Generally tubular grommet fastener 42 projects from upper surface 38 of base 36 along an axis generally perpendicular thereto. Grommet fastener 42 includes sidewall 43 having a predetermined diameter. Sidewall 43 has an upper end 44 and a lower end 46. It is contemplated to integrally mold spacing collar 48 about the outer periphery of sidewall 43 of grommet fastener 42 adjacent lower end 46 thereof. Spacing collar 48 includes a lower surface 51 in engagement with upper surface 38 of base 36 and an upper surface 50. The diameter of spacing collar 48 is greater than the diameter of sidewall 43 of grommet fastener 42, for reasons hereinafter described.

In order to interconnect furniture glide 34 to furniture leg 26, upper end 44 of grommet fastener 42 is positioned along terminal surface 28 of furniture leg 26 at a central location. Thereafter, a hammer or similar tool is used to tap floor engaging surface 40 of base 36 so as to urge sidewall 43 of grommet fastener 42 into terminal end 24 of furniture leg 26. Sidewall 43 of grommet fastener 42 is driven into terminal end 24 of furniture leg 26 until such point that terminal surface 28 of furniture leg 26 engages upper surface 50 of spacing collar 48, thereby providing a vertical gap 52 between terminal surface 28 of furniture leg 26 and upper surface 38 of base 36 of furniture glide 34. Vertical gap 52 is partially defined by the outer periphery of spacing collar 48. It is contemplated that sidewall 43 of grommet fastener 18 be frictionally retained within terminal end 24 of furniture leg 26.

As best seen in FIG. 5, it can be appreciated that the structure of furniture glide 34 allows for furniture glide 34 to be mounted on a furniture leg 26 having an angled terminal surface 28 or to be directly mounted at an angle to the longitudinal axis of furniture leg 26. Alternatively, base 36 of furniture glide 34 may pivot on grommet fastener 42 to insure the apex of floor engaging surface 40 of base 36 of furniture glide 40 remains on constant contact with a supporting surface such as the floor or the like.

Figure 6A:
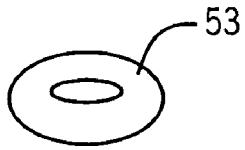
FIG. 6*a* is an isometric view of a first embodiment of a spacing collar for mounting on the grommet fastener of the furniture glide of the present invention.
Figure 6B:
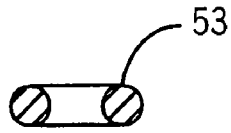
FIG. 6*b* is a cross-sectional view of the spacing collar of FIG. 6*a;*
Figure 7A:
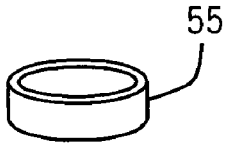
FIG. 7*a* is an isometric view of a second embodiment of a spacing collar for mounting on the grommet fastener of the furniture glide of the present invention.
Figure 7B:
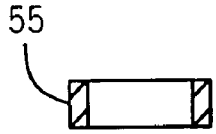
FIG. 7*b* is a cross-sectional view of the spacing collar of FIG. 7*a*.

It can be appreciated that spacing collar 48 integrally molded about sidewall 43 of grommet fastener 42 may be replaced with o-ring 53, FIGS. 6A and 6B, or a generally tubular collar 55, FIGS. 7A—7B, that are slidable over the outer periphery of sidewall 43 of grommet fastener 42. As such, o-ring 53 or collar 55 acts to separate terminal surface 28 of furniture leg 24 from upper surface 38 of base 36 of furniture glide 34, for reasons heretofore described.

Figure 8:
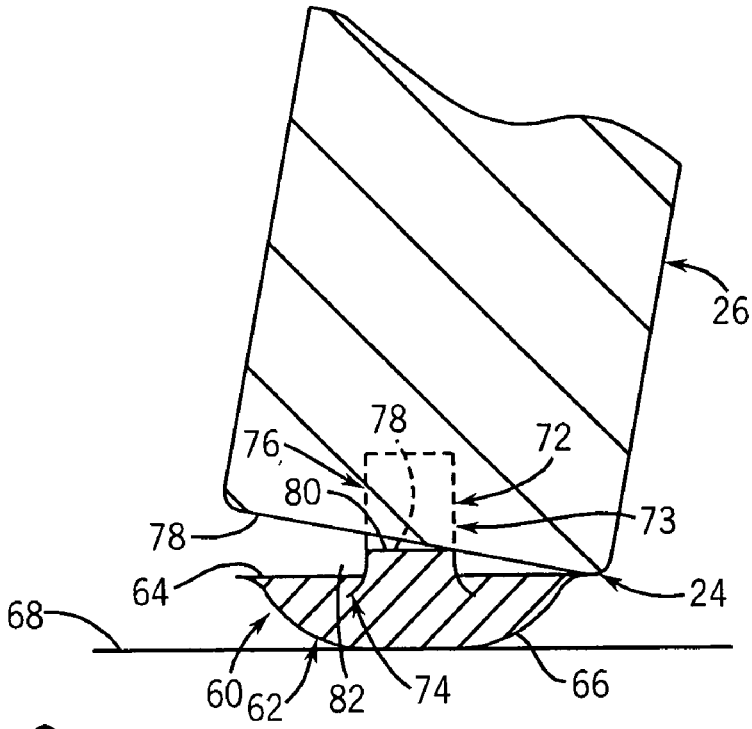
FIG. 8 is a cross-sectional view of a third embodiment of a furniture glide in accordance with the present invention mounted on the terminal end of a furniture leg.

Referring to FIG. 8, a still further embodiment of a furniture glide in accordance with the present invention generally designated by the reference numeral 60. Furniture glide 60 includes base 62 having a generally flat upper surface 64 and a generally arcuate floor engaging surface 66. Floor engaging surface 66 of base 62 may terminate at a generally flat apex for engaging a supporting surface 68 such as the floor or the like.

Furniture glide 60 further includes grommet fastener 72 defined by sidewall 73 having a flared lower end 74 captured within base 62 and an upper end 76. Sidewall 73 of grommet fastener 72 is generally tubular such that spacing portion 78 of base 62 may extend into the interior defined by sidewall 73 of grommet fastener 72 through lower end 74 thereof. Spacing portion 78 of base 62 includes a generally flat terminal surface 80, for reasons hereinafter described.

In order to interconnect furniture glide 60 to furniture leg 26, upper end 76 of sidewall 73 of grommet fastener 72 is positioned against terminal surface 28 of furniture leg 26 at a central location. A tool such as a hammer or the like is used to engage the apex of floor engaging surface 66 of base 62 so as to drive upper end 76 of sidewall 73 of grommet fastener 72 into terminal end 24 of chair leg 26. Sidewall 73 of grommet fastener 72 is driven into terminal end 24 of furniture leg 26 until such point that terminal surface 28 of furniture leg 26 engages upper surface 80 of spacing portion 78 of base 62 within the interior of grommet fastener 72. As described, gap 82 is provided between terminal surface 28 of furniture leg 26 and upper surface 64 of base 62 of furniture glide 60. It can be appreciated that the structure of furniture glide 60 allows for furniture glide 60 to be mounted on the furniture leg 26 having an angled terminal surface 28 or to be mounted at an angle to the longitudinal axis of furniture leg 26. This, in turn, insures that the apex of floor engaging surface 66 remains in contact with supporting surface 68.

Various modes of carrying out the invention are contemplated as being within the scope of the following claims particularly pointing out and distinctly claiming the subject matter that applicant regards as the invention.

I claim:

1. A furniture glide for mounting on a terminal end of a furniture leg, comprising:

a base having an upper surface and a generally arcuate lower surface for engaging a supporting surface; and a hollow generally tubular, grommet fastener having a non-flanged upper end spaced from the upper surface of the base and an outwardly flanged lower end captured in the base the grommet fastener receivable in the terminal end of the furniture leg for frictionally connecting the furniture glide to the furniture leg and including:

an inner surface defining a passageway for receiving a first portion of the furniture leg therein, the passageway extends through the grommet fastener; and an outer surface engageable with a second portion of the furniture leg;

wherein a portion of the base is received in the passageway adjacent the lower end of the grommet fastener.

2. The furniture glide of claim 1 further comprising a spacing collar positioned about the grommet fastener and engageable with the upper surface of the base.

3. The furniture glide of claim 2 wherein the spacing collar is an o-ring.

4. The furniture glide of claim 1 wherein the lower surface of the base terminates at a generally flat apex.

5. A furniture glide for mounting on a terminal end of a furniture leg, comprising:

a slider having an upper surface and a generally arcuate lower surface terminating at a generally flat apex to engage a supporting surface; and a generally tubular fastener extending along a longitudinal axis and projecting from the upper surface of the slider, the fastener having an inner surface defining a passageway therethrough, a first non-flanged upper end receivable in the terminal end of the furniture leg for frictionally connecting the furniture glide to the furniture leg and a second flanged lower end captured with the slider such that a portion of the slider is received in the passageway.

6. The furniture glide of claim 5 further comprising a spacing collar positioned about the fastener and engageable with the upper surface of the slider.

7. The furniture glide of claim 6 wherein the spacing collar is an o-ring.

8. The furniture glide of claim 6 wherein the spacing collar is integrally molded with the fastener.

9. A furniture glide for mounting on a terminal end of a furniture leg, comprising:

a slider having an upper surface and a generally arcuate lower surface for engaging a supporting surface;

a generally tubular fastener extending along a longitudinal axis and projecting from the upper surface of the slider, the fastener having an inner surface defining a passageway therethrough a first non-flanged upper end receivable in the terminal end of the furniture leg for frictionally connecting the furniture glide to the furniture leg and a second flanged end captured in the slider such that a portion of the slider is received in the passageway; and a spacing element on the upper surface of the slider for spacing the upper surface of the slider from the furniture leg.

10. The furniture glide of claim 9 wherein the spacing element includes an o-ring.

11. The furniture glide of claim 9 wherein the spacing element is integrally molded to the fastener.

* * * * *